US009542919B1

(12) United States Patent
Bencar et al.

(10) Patent No.: US 9,542,919 B1
(45) Date of Patent: Jan. 10, 2017

(54) CYBER REALITY MUSICAL INSTRUMENT AND DEVICE

(71) Applicant: Beamz Interactive, Inc., Albuquerque, NM (US)

(72) Inventors: Gary Bencar, Haiku, HI (US); Gerald Henry Riopelle, Scottsdale, AZ (US); Todd Nystrom, Renton, WA (US)

(73) Assignee: BEAMZ INTERACTIVE, Inc., Scottsdale, AZ (US)

( * ) Notice: Subject to any disclaimer, the term of this patent is extended or adjusted under 35 U.S.C. 154(b) by 0 days.

(21) Appl. No.: 15/215,427

(22) Filed: Jul. 20, 2016

(51) Int. Cl.

| | |
|---|---|
| ***G10H 1/00*** | (2006.01) |
| ***G10H 1/18*** | (2006.01) |
| ***G10H 3/00*** | (2006.01) |
| ***G10H 7/00*** | (2006.01) |

(52) U.S. Cl.
CPC ..... *G10H 1/0025* (2013.01); *G10H 1/00* (2013.01); *G10H 1/0008* (2013.01); *G10H 1/0066* (2013.01); *G10H 1/18* (2013.01); *G10H 3/00* (2013.01); *G10H 7/00* (2013.01); *G10H 2210/105* (2013.01); *G10H 2220/111* (2013.01); *G10H 2240/131* (2013.01)

(58) Field of Classification Search
CPC ..... G10H 1/0025
USPC ..... 84/609
See application file for complete search history.

(56) References Cited

U.S. PATENT DOCUMENTS

| | | | | |
|---|---|---|---|---|
| 5,513,129 | A * | 4/1996 | Bolas | G06F 3/011 703/13 |
| 7,915,514 | B1 * | 3/2011 | Shrem | G10H 1/0075 84/615 |
| 8,664,508 | B2 * | 3/2014 | Tabata | G10H 1/0008 84/723 |
| 9,018,508 | B2 * | 4/2015 | Sakurai | G10H 5/00 700/94 |
| 9,171,531 | B2 * | 10/2015 | David | G10H 1/40 |
| 9,208,763 | B2 * | 12/2015 | Avitabile | G09B 15/003 |
| 2005/0223330 | A1 * | 10/2005 | Riopelle | G06F 3/011 715/716 |
| 2005/0241466 | A1 * | 11/2005 | Riopelle | G10H 1/00 84/725 |
| 2008/0122786 | A1 * | 5/2008 | Pryor | A63F 13/02 345/156 |
| 2008/0223196 | A1 * | 9/2008 | Nakamura | G10H 1/0008 84/600 |
| 2008/0240454 | A1 * | 10/2008 | Henderson | G10H 1/0066 381/61 |
| 2009/0114079 | A1 * | 5/2009 | Egan | G09B 15/023 84/477 R |
| 2009/0221369 | A1 * | 9/2009 | Riopelle | G10H 1/00 463/35 |
| 2010/0107855 | A1 * | 5/2010 | Riopelle | G10H 1/0025 84/600 |

(Continued)

*Primary Examiner* — David Warren
*Assistant Examiner* — Christina Schreiber
(74) *Attorney, Agent, or Firm* — Robert C. Klinger

(57) ABSTRACT

Systems and methods for creating and presenting sensory stimulating content in a cyber reality environment. One aspect of the disclosure allows a composer to associate audio content with one or more virtual triggers, and to define behavior characteristics which control the functioning of each virtual trigger. Another aspect of the disclosure provides a variety of user interfaces through which a performer can cause content to be presented to an audience.

18 Claims, 6 Drawing Sheets

(56) References Cited

U.S. PATENT DOCUMENTS

| | | | | |
|---|---|---|---|---|
| 2011/0143837 | A1* | 6/2011 | Riopelle | A63F 13/213 463/35 |
| 2011/0191674 | A1* | 8/2011 | Rawley | G06F 3/016 715/702 |
| 2012/0266741 | A1* | 10/2012 | Bencar | G10H 1/0008 84/645 |
| 2013/0118339 | A1* | 5/2013 | Lee | G10H 1/32 84/725 |
| 2013/0138233 | A1* | 5/2013 | Sandler | G06F 17/00 700/94 |
| 2013/0291708 | A1* | 11/2013 | Orshan | G10H 1/02 84/626 |
| 2015/0046808 | A1* | 2/2015 | Dejban | G06F 3/165 715/716 |
| 2015/0243083 | A1* | 8/2015 | Coggins | G06T 11/00 345/633 |
| 2016/0104471 | A1* | 4/2016 | Hyna | G10H 1/386 84/613 |
| 2016/0179926 | A1* | 6/2016 | Leppenen | G06F 17/30598 707/738 |

* cited by examiner

CYBER REALITY MUSICAL INSTRUMENT AND DEVICE

FIELD OF THE INVENTION

This disclosure relates to the composition and performance of sound and video content in a cyber reality environment.

SUMMARY OF THE DISCLOSURE

This disclosure relates to the composition and performance of sensory stimulating content, such as, but not limited to, sound, video, and cyber reality content. More specifically, the disclosure includes a system through which a composer can pre-package certain sensory stimulating content for use by a performer. Another aspect of the disclosure includes an apparatus through which the performer can virtually trigger and control the presentation of the pre-packaged sensory stimulating content. A common theme for both the composer and performer is that the pre-packaged sensory stimulating content is preferably chosen such that, even where the performer is a novice, the sensory stimulating data is presented in a pleasing and sympathetic manner.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

The present disclosure enables a performer to create sympathetic music using a plurality of triggers in a cyber environment, including cyber reality, technology assisted reality, and augmented reality.

Figure 1:
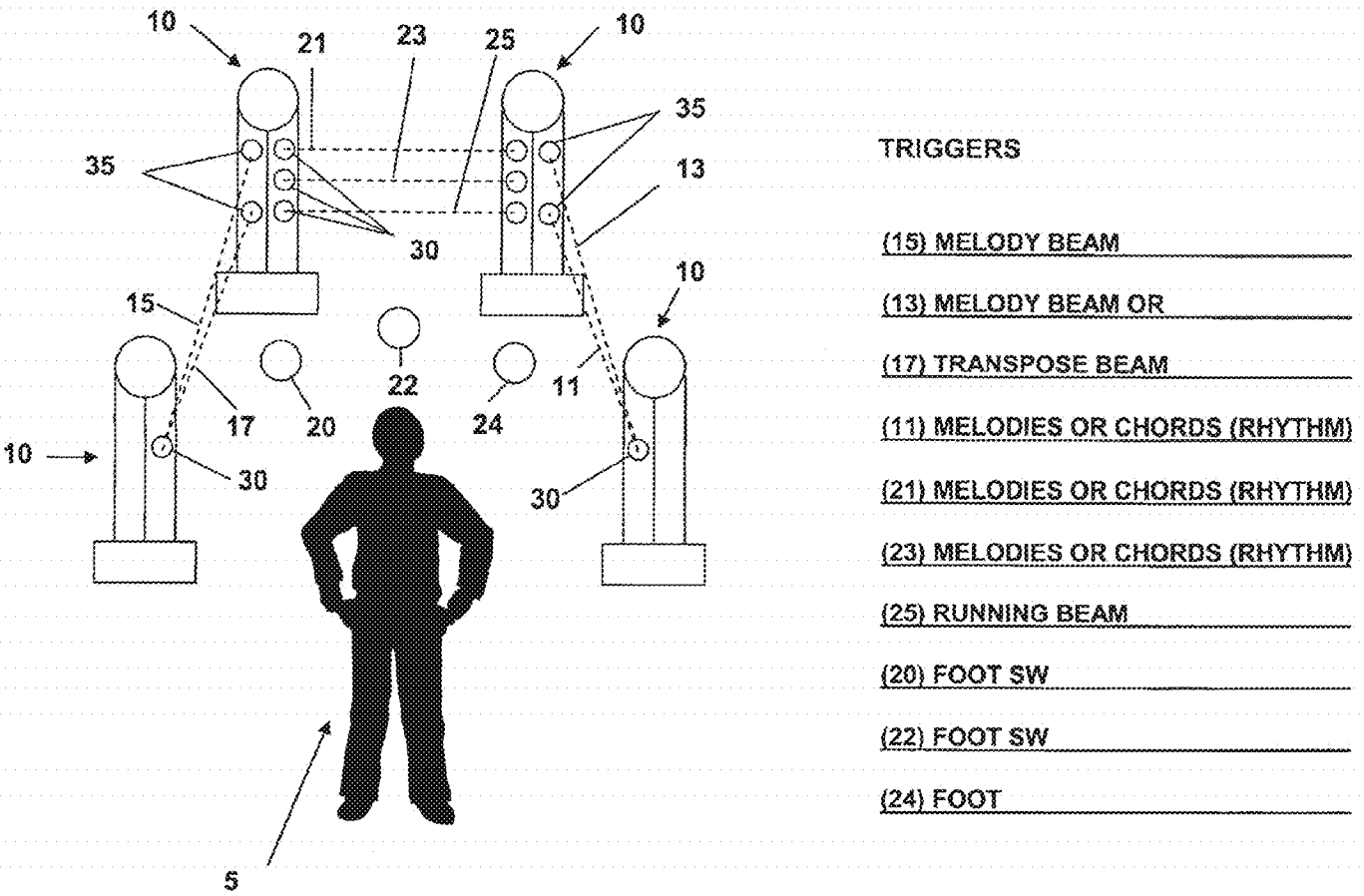
FIG. 1 is a block diagram of a non-virtual content presentation user interface.

FIG. 1 is a block diagram of an embodiment of a content presentation user interface in a non-cyber reality environment. In FIG. 1, block 5 represents the performer. In the illustrated embodiment, the performer stands between posts 10, and is surrounded on three sides by light beams 11, 13, 15, 17, 21, 23, and 25. Light emitters 30 generate the light beams, and the light beams are preferably aimed at light detectors 35. Light detectors 35 are attached to, or embedded in, posts 10, and each light detector 35 serves as a trigger for the system. The three foot switches, blocks 20, 22, and 24, represent additional triggers that are available to the performer. Each time the performer breaks light beams 11 or steps on foot switches 20, 22, or 24, this activates the trigger associated with the light beam or switch. A corresponding signal from the trigger is then sent to a computer, synthesizer, or other such device, and causes the presentation of content associated with the activated trigger. Two or more activated triggers create a composition, including but not limited to sympathetic music whereby each trigger is associated with a music program, and the music programs are synchronized when the music programs are played. Each music program may comprise a sub-part of a composition, such as a subset of a song where each subset corresponds to a particular instrument's portion. These music programs can consist of one or more MIDI files, samples such as .wav and .mp3 files, etc.

Figure 2:
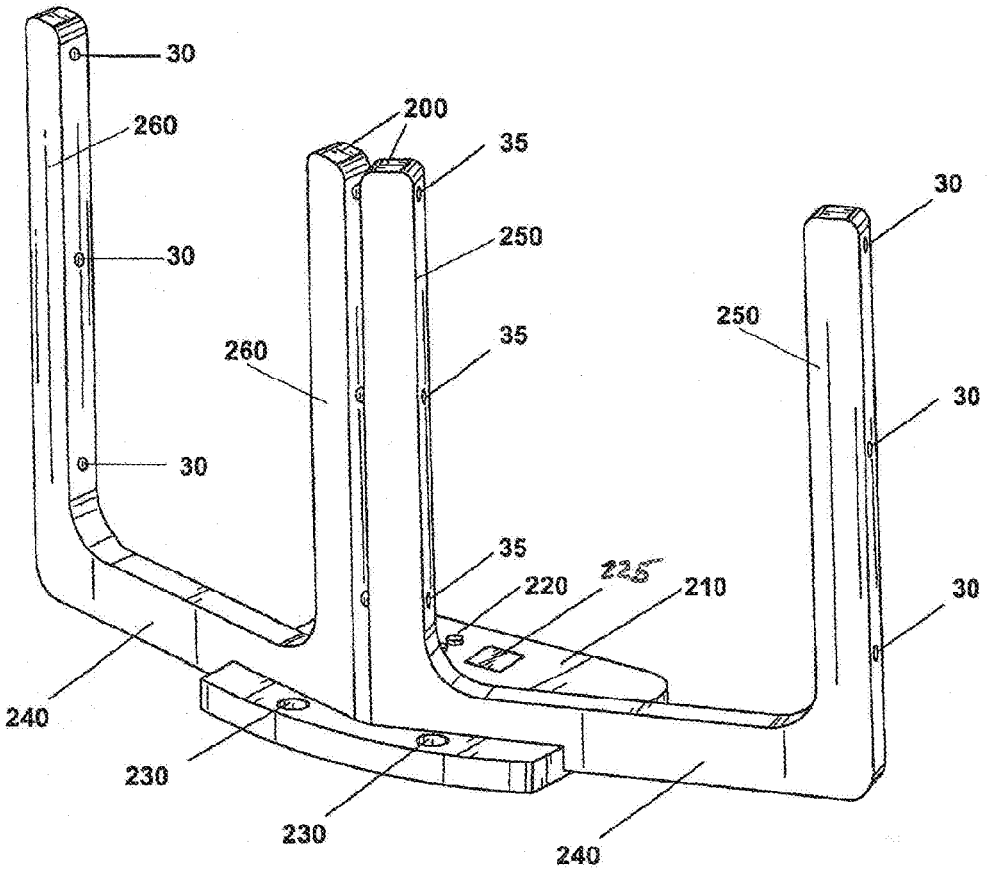
FIG. 2 is a rear perspective view of a portable, table-top content presentation user interface.

FIG. 2 is a rear perspective view of a portable, table-top content presentation user interface. In the embodiment illustrated in FIG. 2 light emitters 30 and light detectors 35 are preferably embedded within each arm (250, 260) of "U" shaped members 200, thereby simplifying aiming of the light beams and reducing the likelihood that the emitters or detectors will be misaligned during transport.

Members 200 can be easily attached to base 210 by inserting base 240 of members 200 into an appropriately sized groove in base 210. This allows base 210 to support members 200; places members 200 at a comfortable, consistent angle; and allows members 200 to be electronically connected to base 210 via cables (not illustrated) that plug into ports 230.

Base 210 also preferably includes switches 220 and 225, and a display 215. Switches 220 and 225 can be configured to allow a performer to switch from program to program, or from segment to segment within a program; adjust the intensity with which the content is presented; adjust the tempo or pitch at which content is presented; start or stop recording of a given performance; and other such functions. Display 215 can provide a variety of information, including the program name or number, the segment name or number, the current content presentation intensity, the current content presentation tempo, or the like.

When the embodiment illustrated in FIG. 2 is active, light emitters 30 generate light beams which are detected by light detectors 35. Each time the performer breaks the light beams or activates one of switches 220 or 225, the trigger associated with the light beam or switch is activated. In one embodiment, a corresponding signal is sent to a computer, synthesizer, or other such device via a Universal Serial Bus (USB) or other such connection. Such a signal causes the device to present the content associated with the activated trigger. A music program can be associated with each trigger, wherein each music program is a subset of a master composition, such as the guitar portion or the keyboard portion of the master composition. Thus, when an associated trigger is triggered, the associated music program is played and synchronized to the other music program to create a sympathetic musical output, such disclosed in greater detail in commonly assigned U.S. Pat. 7,504,577 B2.

In an alternative embodiment, base 210 and/or members 200 may also contain one or more speakers, video displays, or other content presentation devices, and one or more data storage devices, such that the combination of base 210 and members 200 provide a self-contained content presentation unit. In this embodiment, as the performer activates the triggers, base 210 can cause the content presentation devices to present the appropriate content to the audience. This embodiment can also preferably be configured to detect whether additional and/or alternative content presentation devices are attached thereto, and to trigger those in addition to, or in place of, the content presentation device(s) within the content presentation unit.

According to one embodiment of this disclosure, the light based triggers are substituted with triggers operable in cyber reality. Cyber reality is defined as the collection of virtual reality, technology assisted reality, and augmented reality that do not require the performer to physically touch the trigger in order to activate it.

VIRTUAL AND AUGMENTED REALITY

Virtual Reality (VR), Mixed Reality, Technology Assisted Reality, and Augmented Reality can be collectively lumped together with the term Cyber Reality. For simplicity, the collective term will be applied here.

The cyber environment is what the user sees or experiences within the cyber reality display, which often requires the user to wear a special headset viewer.

A Virtual Trigger can be any interactive object or element within the cyber environment that indicates when a user interacts with it. These interactive cyber reality objects/elements are spatial with respect to the overall display and they send standard Gestures or notifications to the Application Engine when the user interacts with them in a prescribed way. For purposes of this disclosure, these Interactive Cyber Reality objects will be referred to as Virtual Triggers.

Cyber Reality provides a plurality of great possibilities for making the end users musical experience even better and more immersive by creating the perfect environment to fit the overall mood of a song. This not only allows a user to listen to the music that they, and others are creating, but it puts them inside the music they are making. Musically Augmented Reality (environments) can bring everyone, musicians and non-musicians alike, closer to this experience than ever before.

Infinite possibilities exist for presenting the virtual triggers in a Cyber Reality environment. Virtual trigger imagery is referred to as the Foreground and it appears on top of, or in front of, the Background imagery. What the user sees behind the Foreground is the Background.

Foreground and Background manipulations that are based on a triggered interactive music provide broad application for music. The music being triggered dynamically affects the Cyber Reality environment on a real-time basis.

There are many possibilities for Foreground and Background manipulations based on trigger activity and/or the sound being produced.

Being able to manipulate (create) the background environment is one of the biggest advantages of Cyber Reality. Immersive "Interactive Music Videos" can be created that puts the user INSIDE the music which takes their music playing experience to a whole new level. In an example, a cyber reality can be created where the user perceives himself as being up on the stage as part of a performing band and playing along with them on the instrument of his choice, and/or playing with a virtual image of his favorite artist.

FOREGROUND EXAMPLES:

Foreground Controller

A virtual hologram version of a laser controller, or other types of controllers, can be positioned in front of the user where passing a hand thru the virtual laser beams (or other controls) triggers the instruments as they do on the physical unit.

Foreground Interactive Icons

Virtual Triggers are virtual instrument images or other icons that float in front of the user. The virtual triggers are spatial within the cyber reality environment (display) and the user can position them wherever they want. Briefly pass the hand thru them to play a one-shot or hold the hand in an object to pulse it. In some cases a hand-held controller can be used. Visual feedback can be provided for trigger activity. While a trigger is being broken it could glow, or it could emit a single music note icon for a one-shot and a stream of icons to illustrate pulsing.

Strategic placement in the Cyber Environment

Placing the virtual triggers strategically in the Cyber Reality Environment brings immense benefits to therapy applications by allowing health care practitioners to set up programs designed to focus on specific therapy models.

Cueing

Virtual triggers can be manipulated to stand out as to suggest when it would be a good time to play that instrument. For kids' songs, the instrument images could rock back & forth to the (real-time) music.

BACKGROUND EXAMPLES:

Background environments can be linked to the virtual (music program) triggers so the total environment is affected by what the user plays.

Background Color Organ

Color organs assign a color to a specific frequency range of an audio track—typically 3 or 4 color ranges. Each range illuminates its respective colored light where the brightness is linked with the volume level. Depending on which frequency ranges are the loudest at the moment, different variations of colors are produced, and they all pulse with the music they represent. Although color organs have been around for a long time, this behavior can be mimicked by assigning the different colors to each of the beam triggers, where their brightness is controlled by the audio output level of the trigger being broken. This makes the background environment part of the interactive music experience as well.

Figure 3:
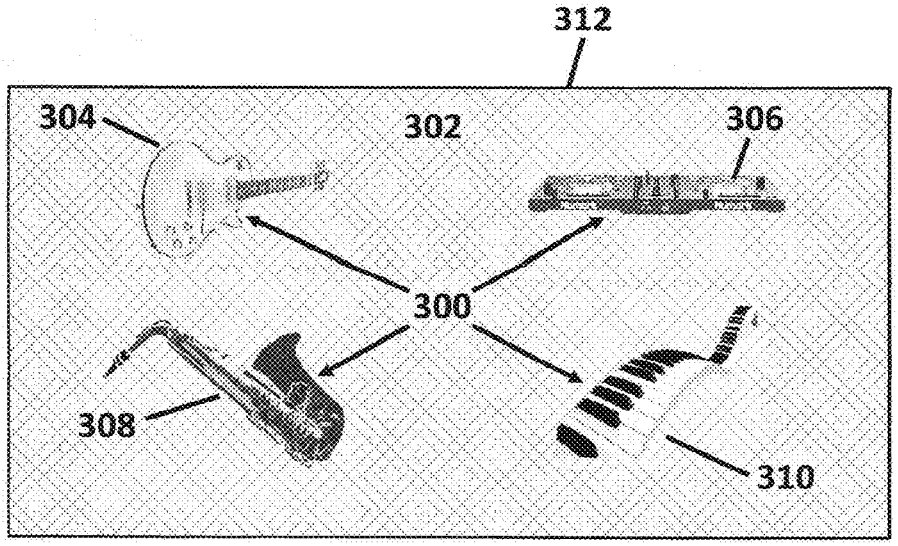
FIG. 3 illustrates virtual (foreground) triggers.

FIG. 3 illustrates four virtual triggers 300 in the Foreground cyber environment. The virtual triggers 300 are shown on top of an empty Background environment 302. The illustrated virtual triggers 300 are Guitar 304, DJ Deck 306, Saxophone 308, and Keyboard instrument 310. The virtual triggers 300 are spatial and "float" in front of the background environment 302 collectively forming a cyber environment 312.

There can be any number of virtual triggers 300, and the virtual triggers 300 can be placed anywhere in the cyber environment 312, directly in front of the user, or off to the side, requiring the user to look to the side to see them.

Figure 5:
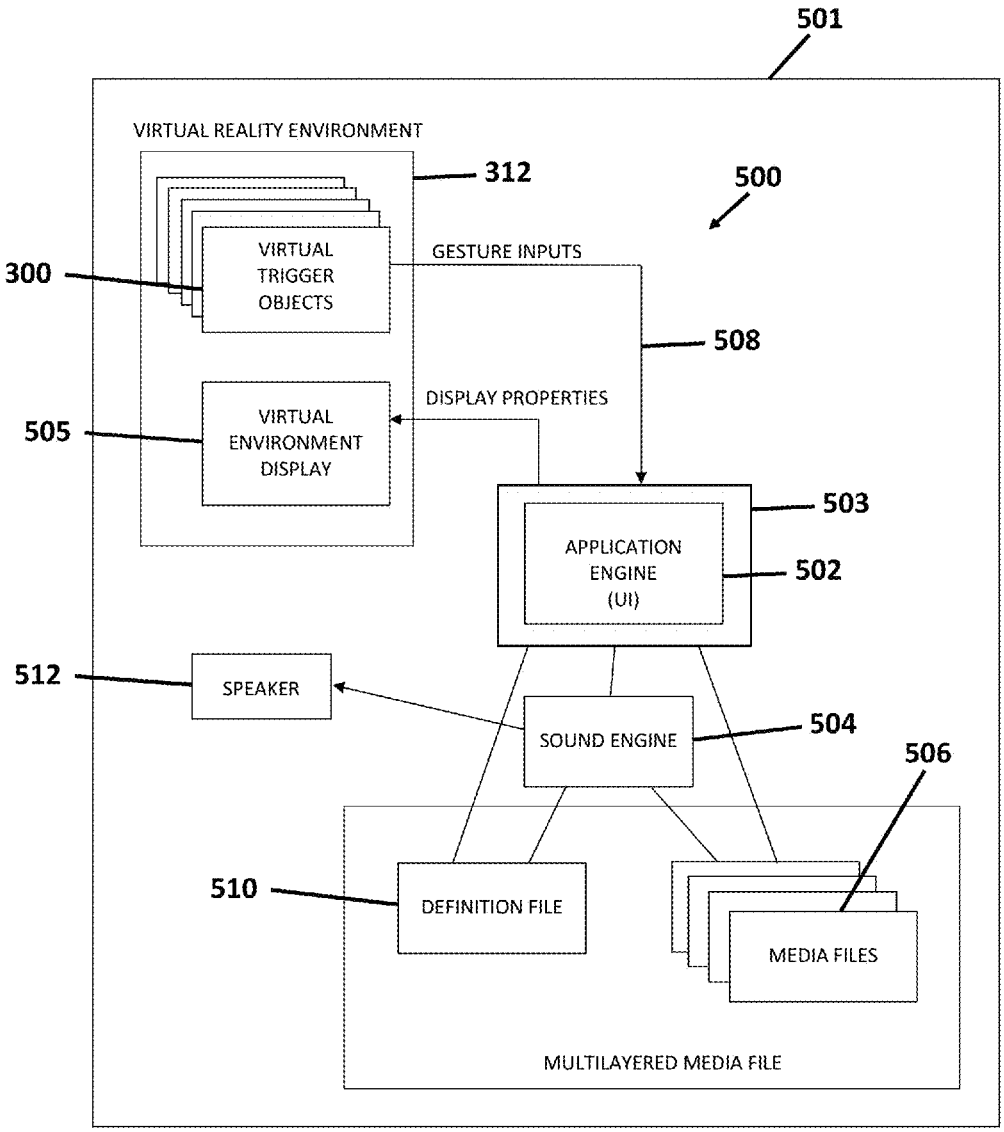
FIG. 5 illustrates a hardware diagram of a controller and a plurality of virtual triggers.

The virtual trigger 300 can be any Cyber Reality object or element that indicates when a user interacts with it. These interactive Cyber Reality objects/elements send standard gestures or notifications to an Application Engine 502, as shown in FIG. 5, when the user interacts with them in a prescribed way. The Application Engine 502 sends a Trigger-ON notification to a sound engine 504 when a gesture is received from a virtual trigger 300, and a corresponding Trigger-OFF is sent when the gesture ends.

Interactive virtual triggers 300 are configured to manipulate the Foreground environment to provide visual feedback on a display when they are triggered, such as, but not limited to, highlighting or altering the trigger imagery in some way, or by introducing additional graphic objects into the foreground. Such trigger-specific manipulations cause the cyber reality Foreground to be dynamically linked to the music programs such as previously described that are being interactively triggered.

Background Kaleidoscope

A kaleidoscope is rendered as background—optionally pulsing to the music.

Each virtual (music program) trigger 300 is assigned to alter a component in a formula that produces the kaleidoscopic image, altering the color, or the kaleidoscope imagery when it is triggered.

Figure 4:
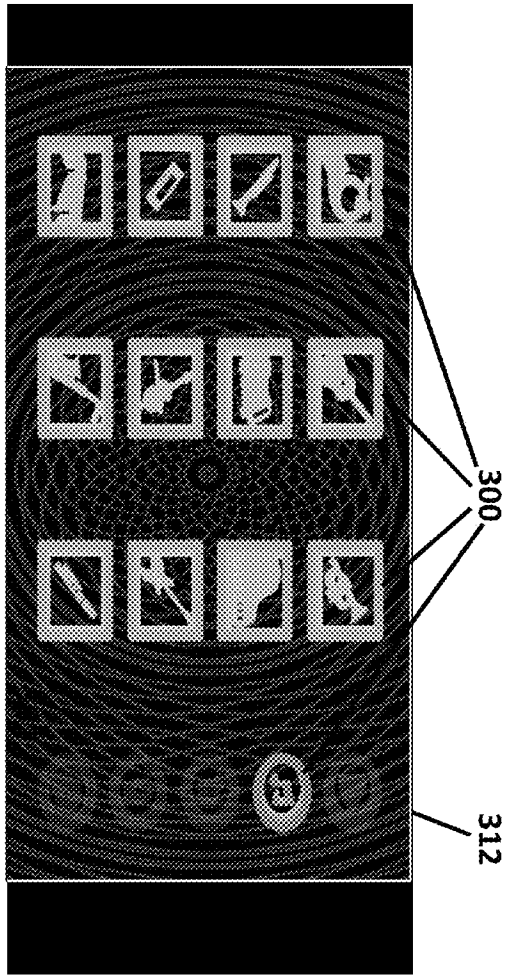
FIG. 4 illustrates multiple virtual triggers on top of a music-linked interactive background environment.

FIG. 4 shows an embodiment of a cyber environment 312 where the virtual triggers 300 are arranged to present a wall of music instrument icons in front of the user within the cyber environment 312. The virtual triggers 300 appear in front of a background environment 302 consisting of an interactive kaleidoscope that is being controlled by the virtual (music program) triggers 300.

The virtual triggers 300 are configured to manipulate the background cyber environment 302 when they are triggered, such as, but not limited to, modifying the color properties of specific elements in the display or changing the imagery entirely.

On an individual basis, each virtual trigger 300, or the sound produced by the virtual trigger 300, controls or adjusts a unique color component for the display. The brightness of the color could optionally be linked to the volume level of the sound being produced by the virtual trigger 300.

In addition, each virtual trigger 300 can increase or decrease the value of a property used to generate the kaleidoscopic design itself (Number of petals, Number of orbits, Radial suction, & Scale factor). The amount of adjustment can be linked to the volume level of the sound being interactively produced by the virtual trigger 300.

The same concept can be applied to simulated multicolored laser displays that draw geometric patterns in the cyber reality background, where the color attributes or geometric rendering properties are manipulated interactively by the virtual triggers 300 and/or the sounds that are interactively produced by the virtual triggers 300.

Such trigger-specific manipulations cause the cyber reality background 302 to be dynamically linked to the music programs that are being interactively triggered.

FIG. 5 illustrates a diagram of a system 500 for multilayered media playback in Cyber Reality in accordance with embodiments of the present disclosure.

The system 500 can be implemented in electronic device 501, and embodied as one of a computer, a smart phone, a tablet, a touchscreen computer, a cyber reality headset 601 and the like having a display 505.

Figure 6:
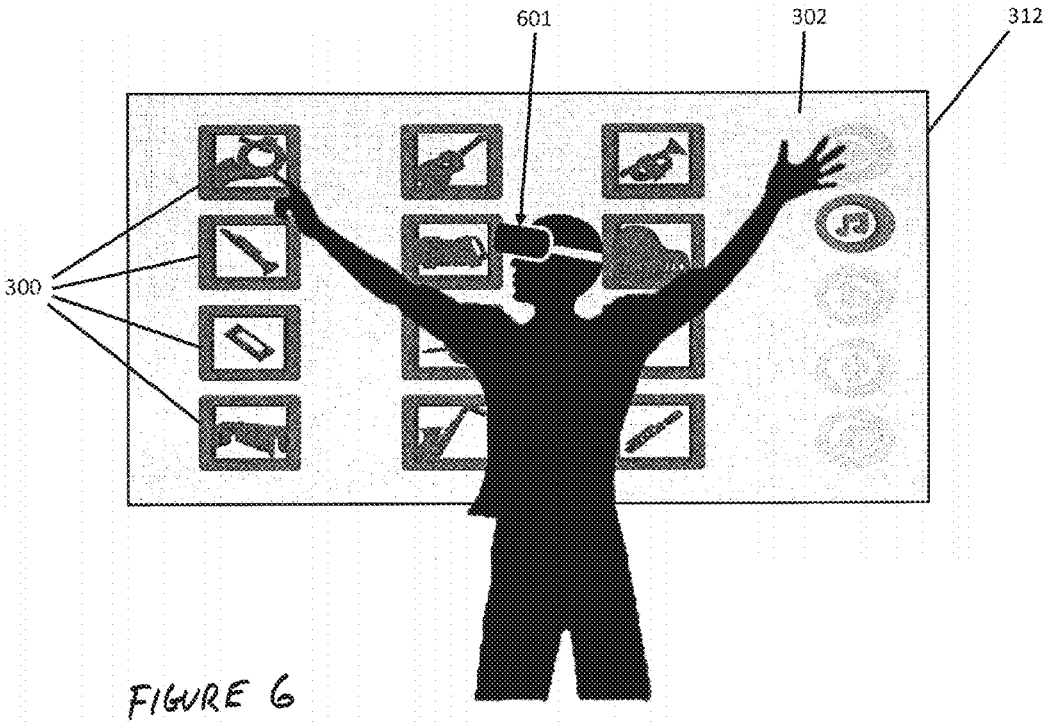
FIG. 6 illustrated how a user interacts with the cyber reality illustrated in FIG. 4.

Application engine 502 is operable on an electronic processor 503 and receives one or more Gestures from the multiple virtual triggers 300 within the cyber reality environment 312, such as shown in FIG. 3, FIG. 4, and FIG. 6.

Application engine 502 controls playback of media files 506 that are combined to form a multilayered media file based on one or more of Gesture inputs 508, and definition file 510 via sound engine 504. The media files 506 can be one or more MIDI files, samples such as .wav and .mp3 files, video files in a plurality of formats, and/or any other audio or video file format.

Gesture inputs 508 include one or more standard gestures that indicate when and how an interactive virtual trigger 300 is being "touched" by the user within the cyber environment 312. Gesture inputs 508 used for triggering may include, but are not limited to, a Tap gesture, and a Tap-and-Hold gesture.

With a Tap gesture, the touch is held at substantially the same point within the virtual trigger 300 for a substantially short period of time, such as with a threshold for the short period of time of 0.5 seconds or less. The application engine 502 can use the Tap gesture to trigger a one-shot, play a single note in a streamed sequence, or start and stop a loop.

With a Tap-and-Hold gesture, the touch is held at substantially the same point within the virtual trigger object 300 a longer period of time, such as with a threshold for the longer period of time of 0.5 seconds or more. Additional thresholds may be used for Tap-and-Hold gesture with each threshold associated with a different action to be taken by the application engine 502.

The Application engine 502 can use a Tap-and hold gesture to Pulse (stream) notes.

Processor 503 is configured such that visual outputs from application engine 502 are displayed within the cyber reality environment 312 and output from sound engine 502 is played on speaker 512. The combination of application engine 502 and sound engine 504 form an application on the processor 503. The processor 503 is configured to selectively associate a music programs with each of the plurality of virtual triggers. The processor 503 is configured such that when one of the virtual triggers 300 is in a first state for a prolonged period of time successive said audible musical sounds are generated, such that, for instance, the musical program associated with the virtual trigger continues to play uninterrupted, along with any other music programs that are playing in response the associated virtual trigger 300 being triggered.

Display 505 displays the total cyber reality environment 312, which includes Foreground and Background visualizations.

When a virtual trigger 300 is virtually touched or triggered by a user Gesture, trigger-specific visual output from application engine 502 can be shown to simulate triggering a virtual trigger 300 within the cyber reality environment 312.

When a virtual trigger 300 is triggered by a user Gesture, trigger-specific visual output from application engine 502 can be shown to alter the display properties or attributes of any element within the cyber reality environment 312, such as the virtual triggers 300 in the Foreground or what the user sees in the Background behind the virtual triggers 300.

FIG. 6 shows how a user interacts with the cyber environment 312 shown in FIG. 4, where the virtual triggers 300 are arranged to present a wall of music instrument icons in front of the user as seen in a cyber reality headset display 601. The virtual triggers 300 appear in the cyber reality space in front of the user who interacts with them by physically reaching out to where the virtual triggers 300 are perceived to be within the cyber reality display 312 and touching them in a prescribed way with hands or a hand-held controller.

Although applicant has described applicant's preferred embodiments of the present disclosure, it will be understood that the broadest scope of this disclosure includes such modifications as diverse shapes, sizes, materials, and content types. Further, many other advantages of applicant's disclosure will be apparent to those skilled in the art from the above descriptions, including the drawings, specification, and other contents of this patent application and the related patent applications.

We claim:

1. A music instrument configured to allow a user to compose musical sounds, comprising:

a plurality of virtual triggers;

an electronic processor responsive to the plurality of virtual triggers, and configured to generate control signals as a function of the virtual triggers selected by a user;

a plurality of music programs, the electronic processor configured to generate an electronic signal as a function of the control signals and the plurality of music programs;

a sound generator configured to generate audible musical sounds as a function of the electronic signal;

a cyber reality headset configured to display the virtual triggers; and wherein each said music program comprises sound elements comprising a subset of a musical composition, the music programs are correlated to each other, and the generated audible musical sounds are synchronized to each other.

2. The music instrument as specified in claim 1 wherein each virtual trigger is associated with a unique musical instrument.

3. The music instrument as specified in claim 2 further comprising a display configured to depict an image indicative of the musical instruments.

4. The music instrument as specified in claim 1 wherein the electronic processor is configured to selectively associate the music programs with each of the plurality of virtual triggers.

5. The music instrument as specified in claim 1 further comprising an application engine controlled by the processor, a definition engine responsive to the application engine, and a plurality of media files including the music programs and accessible by the application engine.

6. The music instrument as specified in claim 1 wherein the virtual triggers are configured such that the plurality of the virtual triggers can be simultaneously controlled by a user's hands or fingers.

7. The music instrument as specified in claim 1 wherein when one of the virtual triggers is in a first state for a prolonged period of time successive said audible musical sounds are generated.

8. The music instrument as specified in claim 1 wherein the audible musical sounds are sympathetic.

9. The music instrument as specified in claim 1 wherein each of the music programs are a subset of a song.

10. A device configured to allow a user to compose musical sounds, comprising:

a plurality of virtual triggers, each virtual trigger associated with a unique musical instrument;

an electronic processor responsive to the plurality of virtual triggers;

a plurality of music programs, the electronic processor configured to generate electronic signals as a function of the plurality of music programs and the plurality of virtual triggers, wherein each said music program comprises sound elements comprising a subset of a predetermined musical composition; and a sound generator configured to generate synchronized sympathetic audible musical sounds as a function of the electronic signals; and a cyber reality headset configured to display the virtual triggers.

11. The device as specified in claim 10 further comprising an application engine controlled by the processor, a definition engine responsive to the application engine, and a plurality of media files including the music programs and accessible by the application engine.

12. The device as specified in claim 11 wherein the virtual triggers are configured such that the plurality of the virtual triggers can be simultaneously controlled by the user's hands or fingers.

13. The device as specified in claim 10 wherein each virtual trigger is associated with a unique musical instrument.

14. The device as specified in claim 13 further comprising a display configured to depict an image indicative of the musical instruments.

15. The device as specified in claim 10 wherein the electronic processor is configured to determine when one virtual trigger has changed state.

16. The device as specified in claim 15 wherein when one of the virtual triggers is in a first state for a prolonged period of time successive said audible musical sounds are generated.

17. The device as specified in claim 10 wherein the electronic processor is configured to associate the music programs with the plurality of virtual triggers.

18. The device as specified in claim 10 wherein the music programs are correlated to each other.

* * * * *